US011219251B2

(12) United States Patent
Ichigaya

(10) Patent No.: US 11,219,251 B2
(45) Date of Patent: Jan. 11, 2022

(54) CLOTHING BODY FOR AIR-CONDITIONED CLOTHING AND AIR-CONDITIONED CLOTHING

(71) Applicant: SFT LABORATORY CO., LTD., Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 42 days.

(21) Appl. No.: 16/484,083

(22) PCT Filed: Nov. 29, 2017

(86) PCT No.: PCT/JP2017/042738
§ 371 (c)(1),
(2) Date: Aug. 6, 2019

(87) PCT Pub. No.: WO2018/146915
PCT Pub. Date: Aug. 16, 2018

(65) Prior Publication Data

US 2020/0022427 A1 Jan. 23, 2020

(30) Foreign Application Priority Data

Feb. 10, 2017 (JP) ..... JP2017-023369

(51) Int. Cl.
*A41D 13/005* (2006.01)

(52) U.S. Cl.
CPC ..... *A41D 13/0053* (2013.01)

(58) Field of Classification Search
CPC ..... A41D 13/0053; A41D 13/0025
USPC ..... 62/259.3
See application file for complete search history.

(56) References Cited

U.S. PATENT DOCUMENTS

| | | | |
|---|---|---|---|
| 7,272,946 | B2 | 9/2007 | Ichigaya |
| 2007/0271939 | A1 | 11/2007 | Ichigaya |

FOREIGN PATENT DOCUMENTS

| | | | |
|---|---|---|---|
| CN | 1886071 | A | 12/2006 |
| CN | 100421592 | C | 10/2008 |
| JP | S53005108 | U | 1/1978 |
| WO | 2005063065 | A1 | 7/2005 |
| WO | 2006009108 | A1 | 1/2006 |

(Continued)

OTHER PUBLICATIONS

International Search Report (ISR) dated Jan. 30, 2018 (and English translation thereof) issued in International Application No. PCT/JP2017/042738.

(Continued)

*Primary Examiner* — Ana M Vazquez
(74) *Attorney, Agent, or Firm* — Holtz, Holtz & Volek PC

(57) ABSTRACT

A clothing body of air-conditioned clothing includes a cloth part and a swell-controlling mechanism. The cloth part includes at least one opening hole to which a fan is attachable, and an air discharge part. The swell-controlling mechanism is provided on the cloth part at a position almost the same as the opening hole in a height direction of the cloth part. The swell-controlling mechanism controls swell of the cloth part around the opening hole and, when the clothing body is worn with the fan being attached to the opening hole, causes the fan to adhere to a wearer's body.

8 Claims, 5 Drawing Sheets

(56) References Cited

FOREIGN PATENT DOCUMENTS

| | | | | |
|---|---|---|---|---|
| WO | WO-2006009108 | A1 * | 1/2006 | ..... A41D 13/0025 |
| WO | 2006098429 | A1 | 9/2006 | |

OTHER PUBLICATIONS

Written Opinion of the International Search Authority dated Mar. 20, 2018 issued in International Application No. PCT/JP2017/042738.

International Preliminary Report on Patentability (IPRP) dated Aug. 13, 2019 (and English translation thereof), issued in International Application No. PCT/JP2017/042738.

Chinese Office Action (and English language translation thereof) dated Sep. 3, 2020 issued in Chinese Application No. 201780086120.X.

* cited by examiner

CLOTHING BODY FOR AIR-CONDITIONED CLOTHING AND AIR-CONDITIONED CLOTHING

TECHNICAL FIELD

The present invention relates to a clothing body for air-conditioned clothing and air-conditioned clothing.

BACKGROUND ART

In recent years, air-conditioned clothing to cool a human body has been put to practical use, rapidly becoming common. Conventional air-conditioned clothing includes a clothing body formed with a material with low breathability, two fans attached to opening holes on the lower back side of the clothing body, a power unit to supply electric power to the two fans, and a power cable to electrically connect the power unit and the two fans.

When the fans are in operation, a large amount of air is taken inside the clothing body by the fans. Pressure of air taken in spontaneously forms air flow path between the clothing body and the body of the wearer, and air taken in flows upward along the surface of the body of the wearer or the underwear through the formed air flow path and is discharged outside through, for example, the openings at the collar or the sleeves.

Then, while air taken in flows through the air flow path between the clothing body and the body of the wearer or the underwear, it evaporates sweat drained from the human body, and the human body is cooled because of the heat of vaporization (for example, see Patent Document 1).

CITATION LIST

Patent Document

Patent Document 1: WO 2005/063065 A1

SUMMARY OF INVENTION

Problem to be Solved

However, in conventional air-conditioned clothing, the surrounding part of the opening holes to which the fans are attached may largely swell because of a positive pressure caused by outside air being taken inside the clothing body or because of reaction when a large amount of air is taken inside the clothing body. The part to which the fans are attached sometimes largely swell, which may be a hindrance to the work.

Further, as the parts to which the fans are attached largely swell, problems described below may occur.

1. When the human body rotates, centrifugal force gets the fans more distant from the human body and it is more likely that the fans hit the surrounding objects.

2. As the fans get distant from the body of the wearer, it is more likely that objects hit the fans, and as the user jumps, it is more likely that an impact is added on the fans. Thus, the fans should be in a durable structure to endure such an impact, and as a result, there may be a secondary deficit such as increase in weight.

An object of the present invention is to provide a clothing body for air-conditioned clothing and air-conditioned clothing, preventing the part to which the fans are attached from swelling.

Solution to Problem

In order to solve the above-described problem, one aspect of the invention provides a clothing body of air-conditioned clothing including:

a cloth part including at least one opening hole to which a fan is attachable, and an air discharge part; and a swell-controlling mechanism which is provided on the cloth part at a position almost the same as the opening hole in a height direction of the cloth part, wherein the swell-controlling mechanism controls swell of the cloth part around the opening hole and, when the clothing body is worn with the fan being attached to the opening hole, causes the fan to adhere to a wearer's body.

The swell-controlling mechanism may include a string-shaped member which is provided along a waist circumference on an inner surface of the cloth part.

A string holder which holds the string-shaped member may be provided on the inner surface of the cloth part, wherein the string holder includes a string holder around the opening hole, and wherein the string holder around the opening hole is provided around the opening hole of the cloth part.

The string holder may include a string holder separate from the opening hole, wherein the string holder separate from the opening hole is provided at a position separate from the opening hole of the cloth part.

The string holder around the opening hole and the string holder separate from the opening hole may include an opening through which the string-shaped member passes, wherein an opening of the string holder around the opening hole has a maximum diameter in a horizontal direction smaller than an opening of the string holder separate from the opening hole.

The string-shaped member may be formed with a material having elasticity.

The string-shaped member may be fixed to the cloth part near the opening hole.

The at least one opening hole may include two opening holes formed at almost the same positions in the height direction of the cloth part, and the string-shaped member may include:

a right string-shaped member which has one end fixed to the cloth part near a right opening hole of the two opening holes;

a central string-shaped member which has one end fixed to the cloth part near the right opening hole and which has the other end fixed to the cloth part near a left opening hole of the two opening holes; and a left string-shaped member which has one end fixed to the cloth part near the left opening hole.

The central string-shaped member may have smaller elasticity than the right string-shaped member and the left string-shaped member.

A first connecting mechanism may be provided at one end of the string-shaped member and a second connecting mechanism may be provided at the other end of the string-shaped member, wherein the first connecting mechanism and the second connecting mechanism are configured to be attachable and removable to and from each other in front of the wearer.

The swell-controlling mechanism may include an adjuster to adjust a length of the string-shaped member.

And air-conditioned clothing can be provided that includes including the clothing body.

Advantageous Effects of Invention

According to the present invention, there may be provided a clothing body for air-conditioned clothing and air-conditioned clothing, preventing the part to which the fans are attached from swelling.

DESCRIPTION OF EMBODIMENTS

Hereinafter, the air-conditioned clothing which is an embodiment of the present invention is described with reference to FIGS. 1 to 5. However, the technical scope of the present invention is not limited to the illustrated examples.

Hereinafter, the description is provided under the definitions that, as the wearer wears the air-conditioned clothing, the front side of the wearer is front, that the back side of the wearer is back, that the upper side of the wearer is upper, that the lower side of the wearer is lower, that the right side of the wearer is right, and that the left side of the wearer is left.

First Embodiment

The air-conditioned clothing 100 of the first embodiment is described with reference to FIGS. 1 to 3.

Configuration of Embodiment

Figure 1:
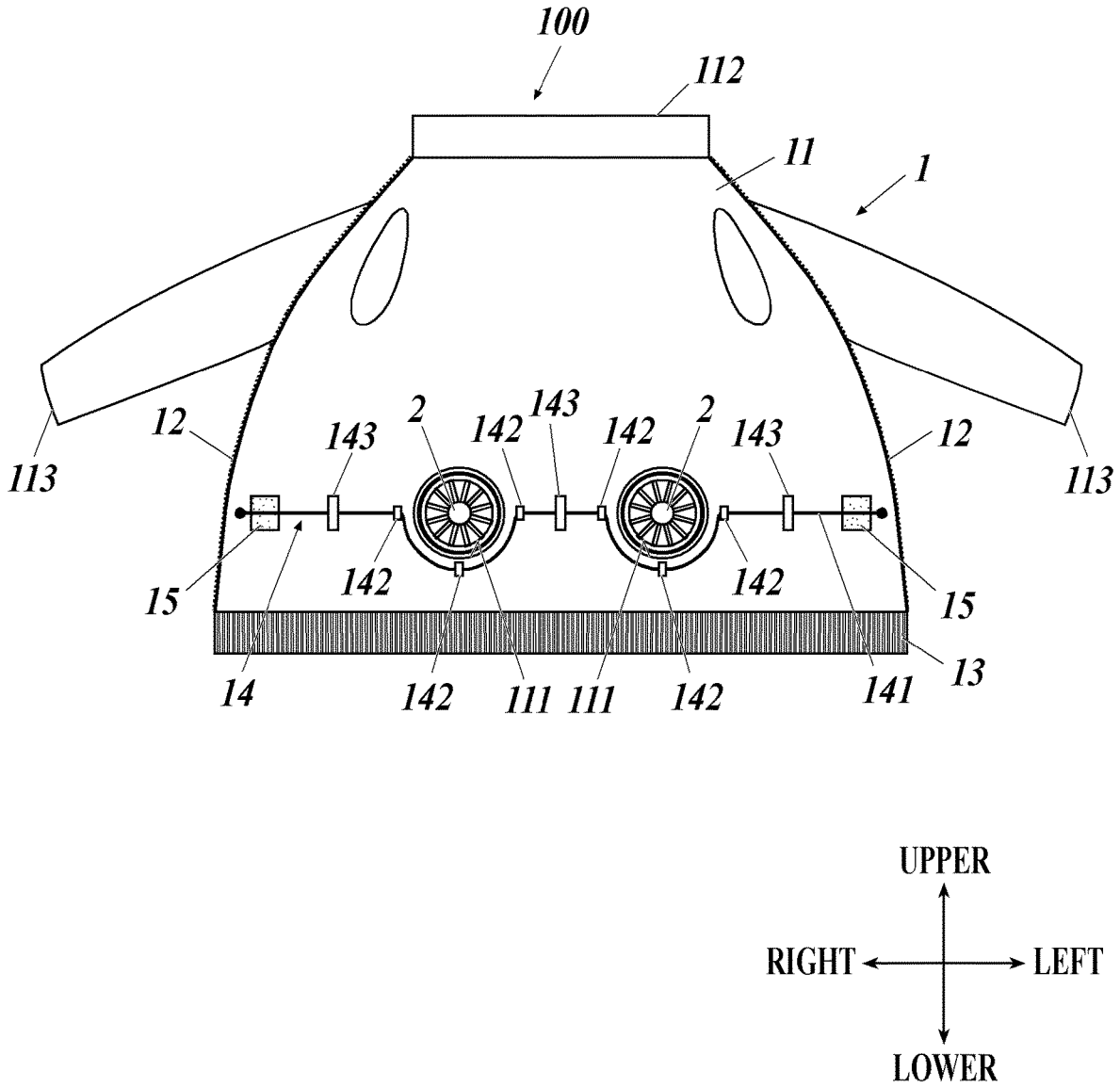
FIG. 1 is a front view of the air-conditioned clothing of the first embodiment when the air conditioned clothing is not worn.

The air-conditioned clothing 100 of the first embodiment includes, as shown in FIG. 1, a clothing body 1, fans 2, 2, a power unit (not shown in the drawings), and a power cable (not shown in the drawings).

Clothing Body

The clothing body 1 includes, as shown in FIG. 1, a cloth part 11, an opener/closer 12, a hem-part airleak preventer 13, a swell-controlling means 14, and a space-maintaining means 15, 15.

Cloth Part

The cloth part 11 is formed with a sheet material without breathability or a sheet material with breathability which allows the clothing to swell by air taken in by the fans 2, 2, in a shape covering the trunk and the arms of the wearer, as shown in FIG. 1. In the present embodiment, as shown in FIG. 1, the clothing body 1 is in a shape of a blouson-type upper garment, but the shape of the clothing body 1 is not limited thereto, and the clothing body 1 may be formed in a shape of a vest covering the trunk of the wearer only, for example. Alternatively, it may also cover the lower half of the body like overalls or a winter coat. In such a case, the hem-part airleak preventer 13 is not always necessary.

Two opening holes 111, 111, a collar-part air discharge part 112, and sleeve-part air discharge parts 113, 113 are formed on the cloth part 11.

The opening holes 111, 111 are holes which are formed at positions respectively corresponding to the left and right of the waist of the wearer of the cloth part 11, and which connect the outside and the space between the cloth part 11 and the body BD of the wearer when the air-conditioned clothing 100 is worn. The two opening holes 111, 111 are formed at positions almost the same in the height direction of the cloth part 11. The fans 2, 2 are attached to the opening holes 111, 111.

The positioning of the opening holes 111, 111 is not limited to the above-described example, and the opening holes 111, 111 may be on the lateral side or the front bodice of the cloth part 11. The number of the opening holes 111 is not limited to two, and there may be less or more than two opening hole(s) 111 . . . with the fan(s) 2 . . . in the corresponding number.

The collar-part air discharge part 112 is an opening which is formed between the neck of the wearer and the edge of the collar of the cloth part 11 so that air taken in through the opening holes 111, 111 by the fans 2, 2 is discharged after flowing along the body BD of the wearer or the underwear.

The sleeve-part air discharge parts 113, 113 are openings which are formed between the arms of the wearer and the edges of the sleeves of the cloth part 11 so that air taken in through the opening holes 111, 111 by the fans 2, 2 is discharged after flowing along the body BD of the wearer or the underwear.

Opener/Closer

The opener/closer 12 is provided on the front part of the cloth part 11 and opens and closes the front part of the cloth part 11 when the air-conditioned clothing 100 is worn. A zipper is used as the opener/closer 12, for example.

Hem-Part Airleak Preventer

The hem-part airleak preventer 13 is a member provided on the lower part of the cloth part 11, as shown in FIG. 1, so as to prevent air in the space between the cloth part 11 and the body BD of the wearer from leaking outside through the hem part of the cloth part 11, and it is formed with a flexible member such as a rubber string being provided around the body BD of the wearer near the edge at the lower part of the cloth 11, for example. When the air-conditioned clothing 100 is worn, air may be prevented from leaking outside from the lower part of the cloth part 11 as the hem part of the cloth part 11 is squeezed by the hem-part airleak preventer 13 and adheres to the body BD of the wearer.

Swell-Controlling Means

Figure 2:
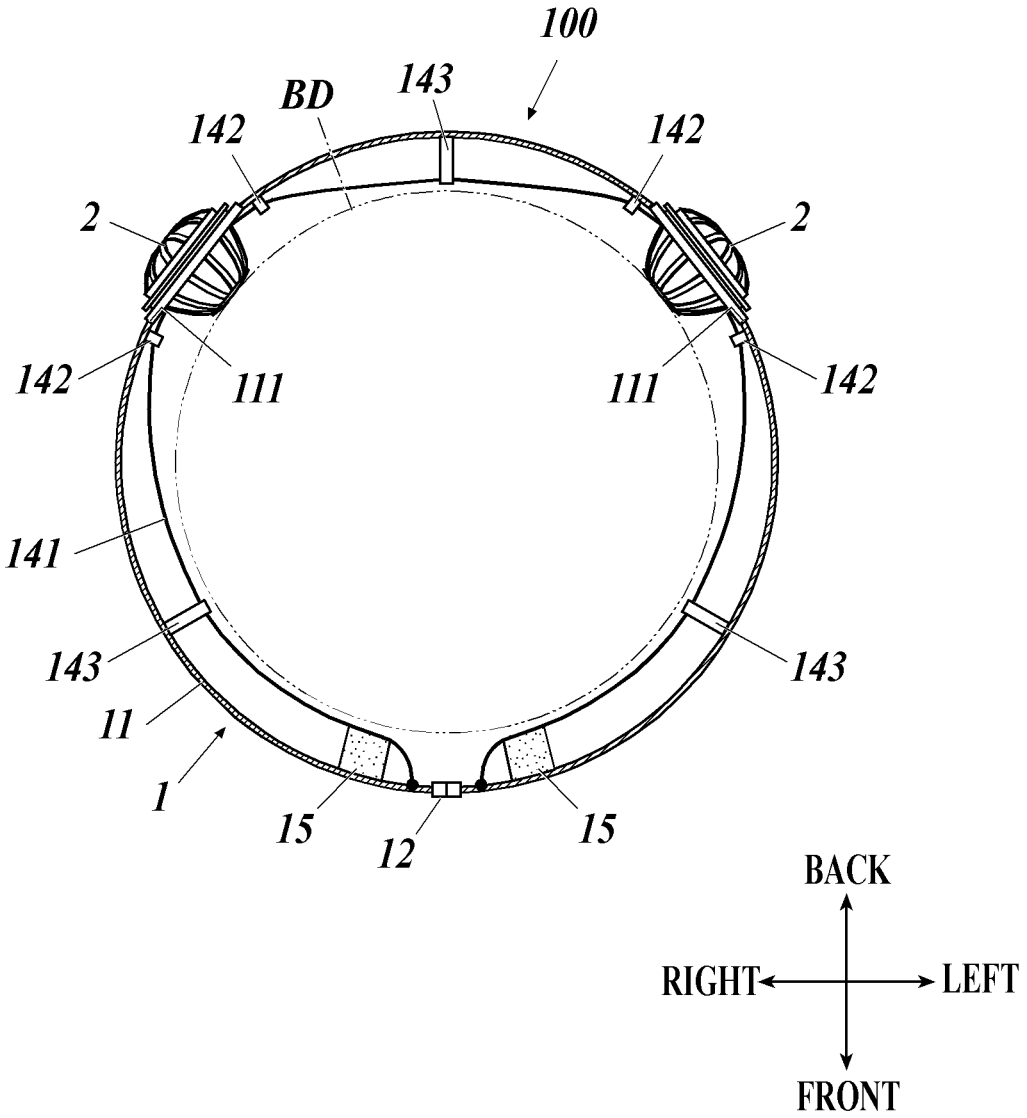
FIG. 2 is a cross-sectional view of the lower part viewed downward from the upper side of fans of the air-conditioned clothing of the first embodiment when the air conditioned clothing is worn.

The swell-controlling means 14 is to control swell of the part of the cloth part 11 where the opening holes 111, 111 are formed and to cause the fans 2, 2 to adhere to the body BD of the wearer of the air-conditioned clothing 100, and includes a string-shaped member 141, string holders around the opening holes 142 . . . , and string holders separate from opening holes 143 . . . , as shown in FIGS. 1 and 2.

String-Shaped Member

The string-shaped member 141 is a string-shaped member formed with an elastic material such as a rubber string, and is provided around the cloth part 11 on the inner surface side except at the part near the opener/closer 12, almost in parallel to the ground, when the air-conditioned clothing 100 is worn, as shown in FIGS. 1 and 2. The string-shaped member 141 is provided at a position almost the same as the positions of the opening holes 111, 111 in the height direction of the cloth part 11, as shown in FIG. 1. The string-shaped member 141 may be in any suitable shape as long as it passes through the string holders around the opening holes 142 . . . , and the string holders separate from the opening holes 143 . . . , and the string-shaped member 141 may also be a belt-shaped member with a fixed width, for example.

As shown in FIG. 1, the both ends of the string-shaped member 141 are fixed to the cloth part 11 on the left and right of the opener/closer 12. The black dot in the figure shows the point at which the string-shaped member 141 is fixed to the cloth part 11. The string-shaped member 141 passes through the string holders around the opening holes 142 . . . , and the string holders separate from the opening holes 143 . . . . However, the points at which the both ends of the string-shaped member 141 are fixed to the cloth part are not necessarily near the left and right of the opener/closer 12 as long as they are on the front bodice of the cloth part 11.

String Holder Around Opening Hole

The string holders around the opening holes 142. have an opening to which the string-shaped member 141 is inserted to pass through, and are provided around the opening holes 111, 111 on the cloth part 11, as shown in FIG. 1, on the left, right, and lower sides of each of the opening holes 111.

The string holders around the opening holes 142 . . . may be formed in various shapes and of various materials, as long as they hold the string-shaped member 141 and control swell of the cloth part 11 around the opening holes 111, 111. For example, they may be formed with a vertically oriented fabric which is sewn at the upper and lower parts like a common belt loop.

The openings of the string holders around the opening holes 142 . . . are formed such that, when the air-conditioned clothing 100 is worn, the maximum diameter of the opening in the horizontal direction is as small as possible while the string-shaped member 141 may pass through the string holder around the opening hole 142. This allows the fans 2, 2 to adhere to the human body enough even if the tension of the string-shaped member 141 is small, as described later.

The maximum diameter in the horizontal direction is, in a case where the shape is changeable like a common belt loop described above, for example, a length of the longest part of the opening in the horizontal direction when it is stretched to the maximum in the horizontal direction. In a case where the shape is not changeable because it is made of metal or the like, for example, the maximum diameter is a length of the longest part of the opening in the horizontal direction in its own shape.

String Holder Separate From Opening Hole

The string holders separate from the opening holes 143 . . . have an opening through which the string-shaped member 141 is inserted to pass through, and are provided on the cloth part 11 at the positions separate from the opening holes 111, 111, and when the air-conditioned clothing 100 is worn, between the opening holes 111, 111, as shown in FIGS. 1 and 2.

In FIGS. 1 and 2, the string holders separate from the opening holes 143 . . . are positioned between the opening holes 111, 111 on the back part of the cloth part 11, between the left opening hole 111 and the opener/closer 12 on the left front part of the cloth part 11, and between the right opening hole 111 and the opener/closer 12 on the right front part of the cloth part 11, though not limited thereto.

The string holders separate from the opening holes 143 . . . may be formed in various shapes and of various materials, as long as they hold the string-shaped material 141 and control swell of the cloth part 11. For example, they may be formed with a vertically oriented fabric which is sewn at the upper and lower parts like a common belt loop.

The openings of the string holders separate from the opening holes 143 are formed such that, when the air-conditioned clothing 100 is worn, the maximum diameter of the opening in the horizontal direction is larger than the string holders around the opening holes 142 . . . so that an appropriate space from the body BD of the wearer is kept for air flow, while the cloth part 11 is prevented from swelling too largely because of pressure of air taken in by the fans 2, 2.

Specifically, in a case where an appropriate space between the body BD of the wearer and the cloth part 11 is 3 cm, for example, the maximum diameter is about 3.3 cm.

Space-Maintaining Means

The space-maintaining means 15, 15 are to keep space for air flow between the cloth part 11 and the body BD of the wearer, and felt with a thickness of several centimeters is used, for example. The space-maintaining means 15, 15 are provided on the cloth part 11 on the left and right of the opener/closer 12, as shown in FIGS. 1 and 2.

In FIGS. 1 and 2, the string-shaped member 141 and the space-maintaining means 15, 15 are provided at the same height and the string-shaped member 141 and the space-maintaining means 15, 15 contact each other. However, the space-maintaining means 15, 15 and the string-shaped member 141 do not necessarily contact each other and the space-maintaining means 15, 15 are just to be provided near the points where the string-shaped member 141 is fixed to the cloth part 11, because the space-maintaining means 15, 15 are to keep space for air flow, preventing the surrounding part of the string-shaped member 141 attached to the cloth part 11 from adhering to the body BD of the wearer with the tension of the string-shaped member 141.

Fans

The fans 2, 2 are attached to the opening holes 111, 111, as shown in FIGS. 1 and 2, so that air is introduced to the space between the cloth part 11 and the body BD of the wearer through the opening holes 111, 111. Any suitable known configuration may be employed for the fans 2, 2, and thus a detailed description thereof is omitted. Necessary electrical power is supplied to the fans 2, 2 by the power unit (not shown in the drawing) and the power cable (not shown in the drawings).

Effects of Embodiment

When the air-conditioned clothing 100 of the first embodiment is worn, air is sent to the inside of the clothing body 1 by the fans 2, 2 through the opening holes 111, 111, and the inside of the clothing body 1 gets under a positive pressure.

As a result, the cloth part 11 swells, but the fans 2, 2 are pressed almost perpendicularly to the body BD of the wearer, adhering thereto, as the surrounding part of the opening holes 111, 111 of the cloth part 11 to which the fans 2, 2 are attached is pulled forward via the string holders around the opening holes 142 . . . with the elasticity of the string-shaped member 141 of the swell-controlling means 14. Then, the part of the cloth part 11 to which the fans 2, 2 are attached may be prevented from swelling to a large extent, and the secondary deficits described above may be prevented.

Further, according to the first embodiment, the string-shaped member 141 does not directly pull the fans 2, 2, but pulls the cloth part 11 around the opening holes 111, 111 via the string holders around the opening holes 142 . . . , and the maximum diameter of the openings of the string holders around the opening holes 142 . . . in the horizontal direction when the air-conditioned clothing 100 is used is as small as possible while the string-shaped member 141 may pass through the opening. Thus, the string-shaped member 141 contacts the cloth part 11 or is extremely near the cloth part 11, when it pulls the string holders separate from the opening holes 142 . . . . .

Because of this, the tension of the string-shaped member 141 required to press the fans 2, 2 to the body BD of the wearer is very small, as explained below. Thus, there is no uncomfortableness caused by the fans 2, 2 adhering to the body.

As described above, the tension of the string-shaped member 141 may be very small, and thus, in a case where a flexible member such as a rubber string is used as the string-shaped member 141 partly or entirely, difference in the torso diameter of the wearer may be disregarded and the length of the string is not necessarily adjusted.

Tension of String-shaped Member

The reason why the tension of the string-shaped member 141 may be small is explained with reference to FIGS. 3A and 3B.

Only the centrifugal force is in consideration hereinbelow, because it is obvious that: the inside of the clothing body 1 gets under the positive pressure as air is taken into the clothing body 1 by the fans 2, 2; and that the fans 2, 2 are subject to very small force of airblow of the fans 2, 2 and thus the centrifugal force when a human moves, or rotates especially, is larger.

Hereinbelow, calculations are performed under the following conditions.

1. The waist is a circle having a circumference of 100 cm (radius 159 mm).
2. The rotation speed is one rotation per second ($\omega=2\pi\times1$).
3. The height of the fans 2, 2 inside the cloth is 30 mm.
4. The weight of the fans 2, 2 is 100 g.
5. The centroid of the fans 2, 2 is at a position of 20 mm from the bottom of the fans 2, 2.

The radius r up to the centroid of the fans 2, 2 is about 179 mm, calculated from 1 and 5 above, and the centrifugal force F is about 0.707 N, calculated by $F=m\omega^2r$.

Figure 3A:
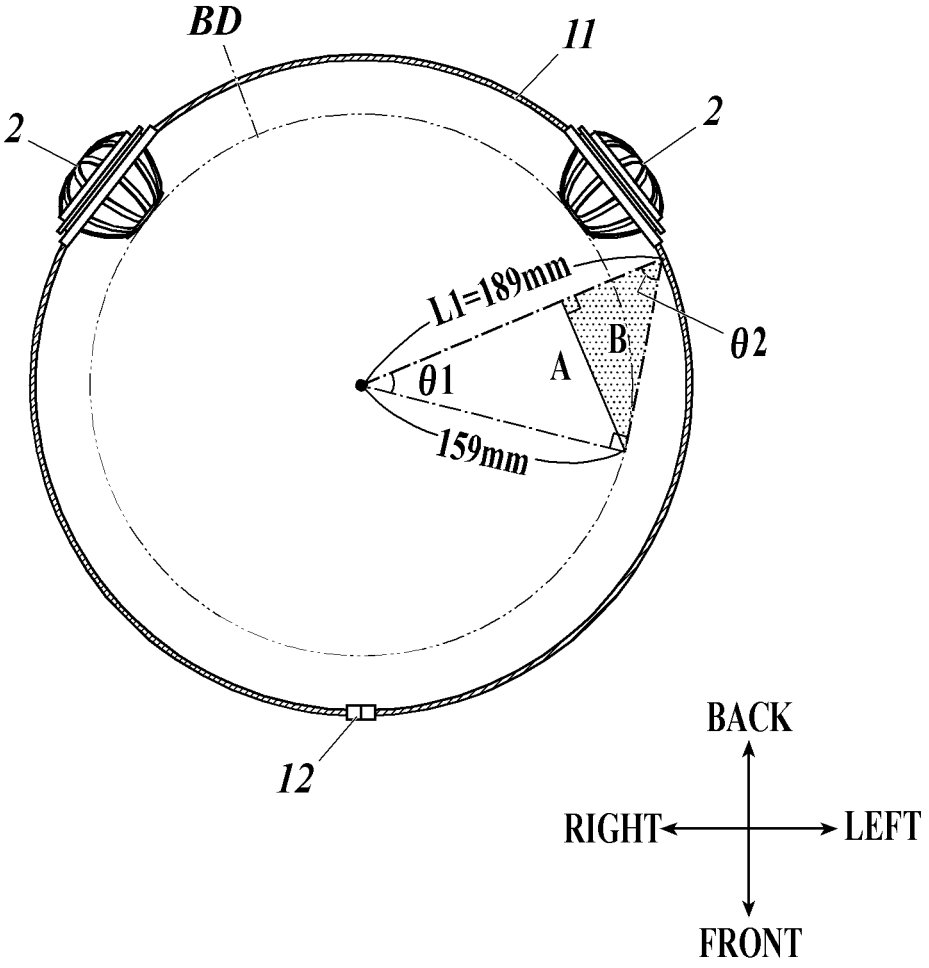
FIG. 3A is an explanatory drawing showing a right triangle A including an angle of pulling a cloth part near an edge of an opening hole by a string-shaped member which passes through a string holder around the opening hole while the string-shaped member contacts a human body.
Figure 3B:
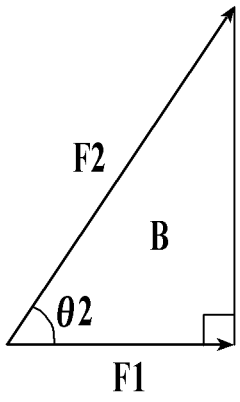
FIG. 3B is a right triangle B of force vectors derived from the triangle A in FIG. 3A.

FIG. 3A shows a right triangle A including an angle of pulling the cloth part 11 near the edge of the opening hole 111 by the string-shaped member 141 which passes through the string holder around the opening hole 142 while the string-shaped member 141 contacts the human body. FIG. 3B shows a right triangle B of the force vectors derived from the triangle A.

The tension of the string-shaped member 141 required to obtain the value 0.707 N of the centrifugal force F described above is calculated as follows.

As shown in FIG. 3A, the height of the fans 2, 2 is 30 mm and the fans contact the circle having a radius of 159 mm. Thus, in the right triangle A, the hypotenuse L1 is 189 mm, and the base is 159 mm. Then, the angle θ1 is about 32.7°, and the angle θ2 is about 57.3°.

As the string-shaped member 141 pulls the surrounding part of the opening hole 111 from the both sides, the tension of the string-shaped member 141 required to produce 0.707 N is 0.354 N on one side. Thus, F2×cos 57.3°=0.343 in the right triangle B, then the tension F2 of the string-shaped member 141 is about 0.65 N.

The calculations above make it obvious that the tension of the string-shaped member 141 is small and that the tension of merely 0.65 N may protect a fan of 100 g against the centrifugal force, as the distance between the surrounding part of the opening holes 111, 111 of the cloth part 11 and the surface of the fans 2, 2 contacting the body BD of the wearer in the direction perpendicular to the body BD of the wearer is large, according to the first embodiment. The present embodiment is a method very reasonable also in this regard.

Modification Example

The string-shaped member 141 is attachable and removable to and from the cloth part 11, and may be suitably selected by the wearer from multiple kinds of the string-shaped members 141.

The string-shaped member 141 may have an adjuster to adjust the length so that the wearer may adjust the length of the part of the string-shape member 141 used for control of swell of the cloth part 11. A cord lock may be used as the adjuster, for example, where the string-shaped member 141 is through the cord lock in a folded state and the fixing position of the cord lock is changed so that the length of the part of the string-shaped member 141 used for control of swell of the cloth part 11 may be adjusted.

In a case where the object is just that the fans 2, 2 adhere to the body BD, the string holders separate from the opening holes 143 . . . and the space-maintaining means 15, 15 are not necessarily provided.

The both ends of the string-shaped member 141 may be fixed to each other in front of the body BD of the wearer without the both ends of the string-shaped member 141 being fixed to the cloth part 11, as a first connecting means and a second connecting means are provided respectively at one end and the other of the string-shaped member 141 and they are attachable and removable to and from each other, in the same way as the second embodiment described later.

The string-shaped member 141 may be suitably modified to be with or without elasticity, in any shape, or at any position, and to be fixed to the cloth part 11 with any method, the string holders around the opening holes 142 . . . may be suitably modified to be in any shape or at any position, and the string holders separate from the opening holes 143 . . . may be suitably modified to be in any shape or at any position, as long as the part of the cloth part 11 to which the fans 2, 2 are attached is prevented from swelling largely.

Second Embodiment

The air-conditioned clothing 100A of the second embodiment is described with reference to FIGS. 4 and 5. The same elements as in the air-conditioned clothing 100 of the first embodiment are labelled with the same reference signs, and descriptions thereof are omitted.

Configuration of Embodiment

Figure 4:
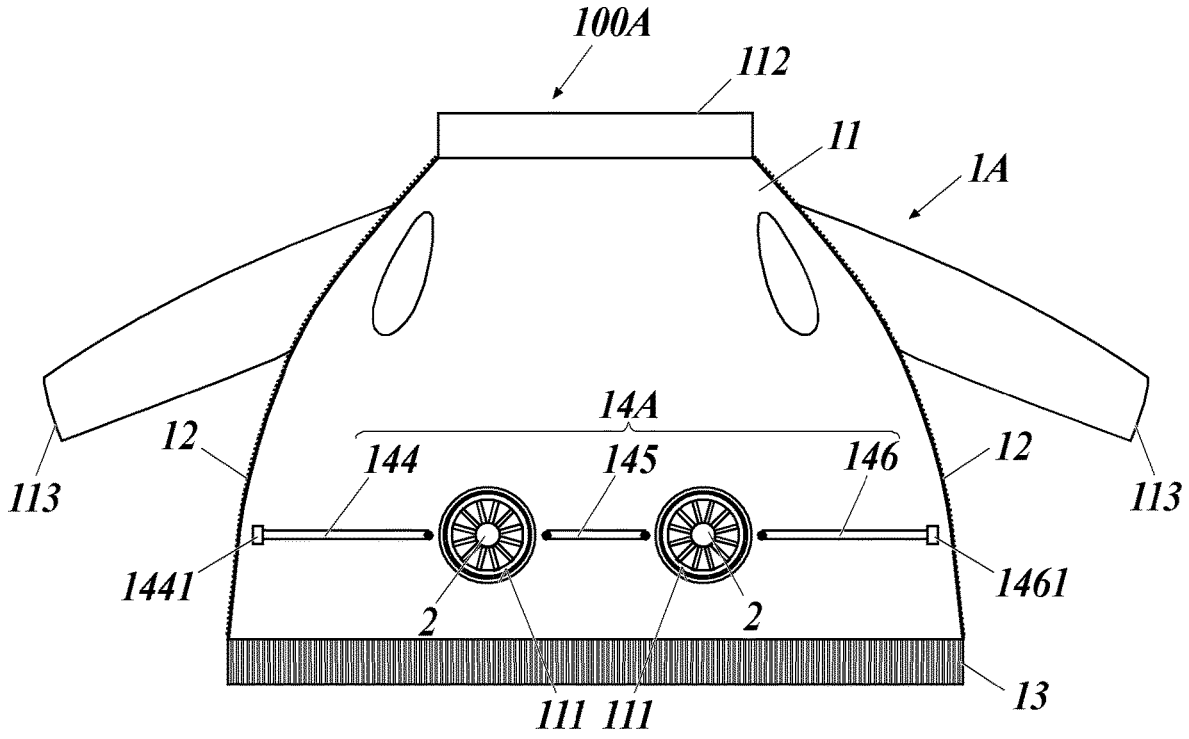
FIG. 4 is a front view of the air-conditioned clothing of the second embodiment when the air conditioned clothing is not worn.
Figure 4:
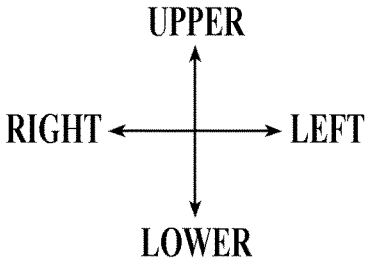
Figure 5:
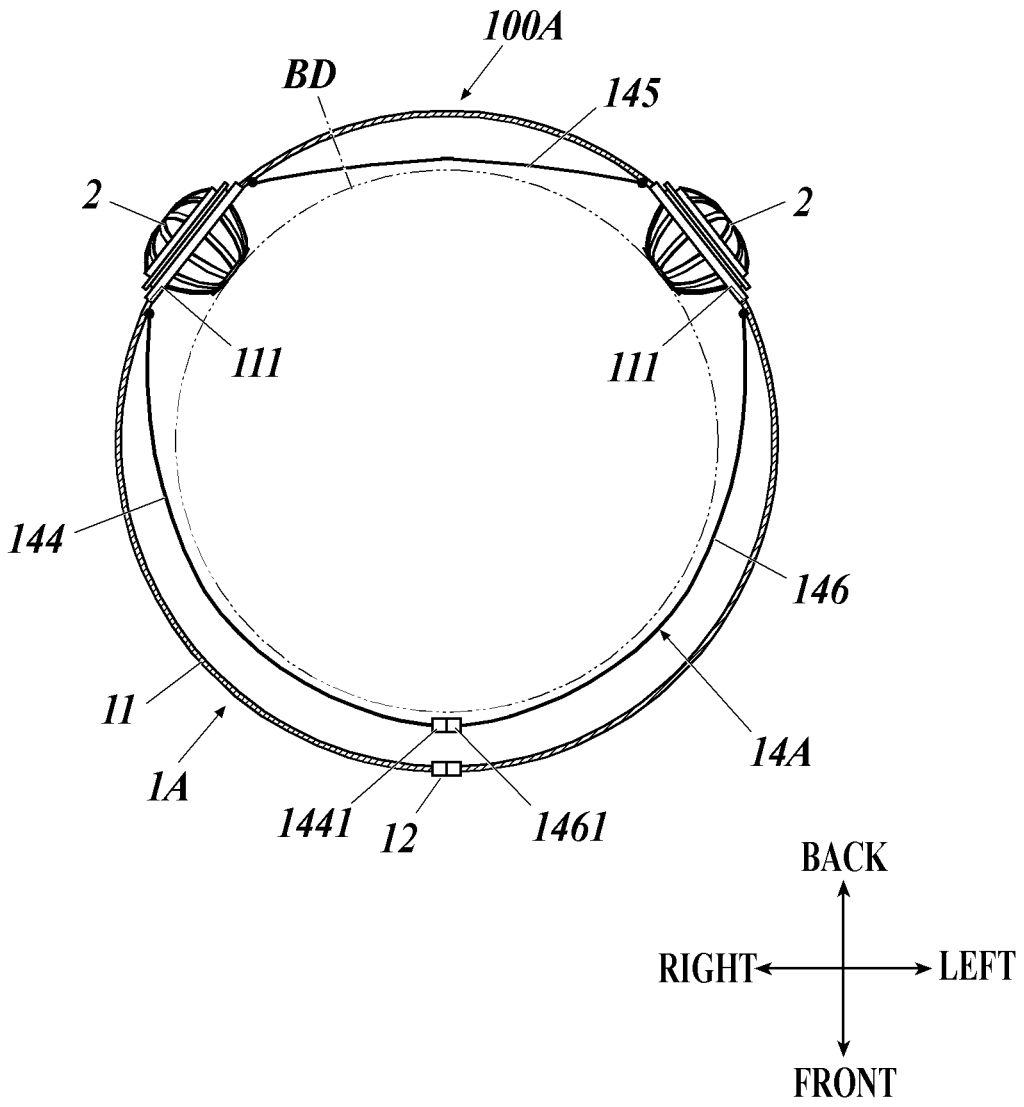
FIG. 5 is a cross-sectional view of the lower part viewed downward from the upper side of fans of the air-conditioned clothing of the second embodiment when the air conditioned clothing is worn.

The clothing body 1A of the air-conditioned clothing 100A includes, as shown in FIGS. 4 and 5, a cloth part 11, an opener/closer 12, a hem-part airleak preventer 13, and a swell-controlling means 14A.

The swell-controlling means 14A is configured with, as shown in FIGS. 4 and 5, a right string-shaped member 144 which is provided on the right of the right opening hole 111, a central string-shaped member 145 which is provided between the opening holes 111, 111, and a left string-shaped member 146 which is provided on the left of the left opening hole 111. In FIG. 4, a belt-shaped member with a fixed width is used as the right string-shaped member 144, the central string-shaped member 145, and the left string-shaped member 146, though not limited thereto, and a narrow string-shaped member may be used, for example.

A member with elasticity may be used as the right string-shaped member 144 and the left string-shaped member 146, and a belt-shaped flat rubber is used, for example.

The right string-shaped member 144 is directly fixed to the cloth part 11 by sewing or such at its one end near the right opening hole 111, as shown in FIGS. 4 and 5. The first connecting means 1441 is provided at the other end.

The left string-shaped member 146 is directly fixed to the cloth part 11 by sewing or such at its one end near the left opening hole 111, as shown in FIGS. 4 and 5. The second connecting means 1461 is provided at the other end.

The first connecting means 1441 and the second connecting means 1461 are attachable and removable to and from each other. When the air-conditioned clothing 100A is worn, the one end of the right string-shaped member 144 which is not fixed to the cloth part 11 and the one end of the left string-shaped member 146 which is not fixed to the cloth part 11 may be fixed to each other in front of the body BD of the wearer, as shown in FIG. 5. Any suitable element such as a connector or a hook may be employed for the first connecting means 1441 and the second connecting means 1461 as long as the one end of the right string-shaped member 144 which is not fixed to the cloth part 11 and the one end of the left string-shaped member 146 which is not fixed to the cloth part 11 are attachable and removable to and from each other.

When the air-conditioned clothing 100A is worn, the wearer closes the opener/closer 12 after connecting the right string-shaped member 144 and the left string-shaped member 146 by fixing the first connecting means 1441 and the second connecting means 1461 to each other.

The central string-shaped member 145 is a member without elasticity, or a member with elasticity smaller than the elasticity of the right string-shaped member 144 and the left string-shaped member 146, and one end thereof is directly fixed to the cloth part 11 by sewing or such near the right opening hole 111 and the other end is fixed to the cloth part 11 by sewing or such near the left opening hole 111, as shown in FIGS. 4 and 5.

The central string-shaped member 145 is formed to be shorter than the distance along the cloth part 11 between the two points of the cloth part 11 at which the central string-shaped member 145 is fixed, as shown in FIG. 5.

The right string-shaped member 144, the central string-shaped member 145, and the left string-shaped member 146 may be fixed to the cloth part 11 with any kind of common method, as long as they may be fixed to the cloth part 11. For example, they may be attachable and removable to and from the cloth part 11 with a button or hook.

Effects of Embodiment

According to the present embodiment, effects similar to the air-conditioned clothing 100 of the first embodiment may be obtained without string holders in the first embodiment. The elasticity of the right string-shaped member 144 and the left string-shaped member 146 may be small, also in such a case.

As the central string-shaped member 145 is a member without elasticity or with elasticity smaller than the elasticity of the right string-shaped member 144 and the left string-shaped member 146, the central string-shaped member 145 may be prevented from being stretched and the distance between the fans 2, 2 may be prevented from varying, as a result of balancing with the right string-shaped member 144 and the left string-shaped member 146. In that way, the distance between the fans 2, 2 may be kept appropriate.

When the air-conditioned clothing 100A is worn, the right string-shaped member 144 and the left string-shaped member 146 are fixed by the first connecting means 1441 and the second connecting means 1461. In that way, the right string-shaped member 144 and the left string-shaped member 146 are not fixed to the cloth part 11 on the front bodice. As a result, the front bodice of the cloth part 11 is not pulled backward or twisted, and the appearance of the air-conditioned clothing when it is worn may be improved. Further, as the string-shaped member is not necessarily sewn on the front bodice of the cloth part, the air-conditioned clothing may be manufactured more easily.

As the central string-shaped member 145 is formed to be shorter than the distance along the cloth part 11 between the two points of the cloth part 11 at which the central string-shaped member 145 is fixed, a loose section is always formed there on the cloth part 11, as shown in FIG. 5. This makes it easier to maintain an air flow path on the back side of the body BD of the wearer.

Modification Example

The right string-shaped member 144, the central string-shaped member 145, and the left string-shaped member 146 may each include an adjuster to adjust the length thereof. A cord lock may be used as the adjuster, for example, as in the modification example of the first embodiment.

In a case where an adjuster is provided on either the right string-shaped member 144 or the left string-shaped member 146, the length may be suitably adjusted using it, and thus the right string-shaped member 144 and the left string-shaped member 146 do not necessarily have elasticity.

The right string-shaped member 144 and the left string-shaped member 146 may be directly fixed to the cloth part 11 on the left and right of the opener/closer 12 as in the first embodiment, without a connecting means.

Further, the right string-shaped member 144, the central string-shaped member 145, and the left string-shaped member 146 may be suitably modified to be in any suitable shape and to be fixed to the cloth part 11 with any method, as long as the part of the cloth part 11 to which the fans 2, 2 are attached may be prevented from swelling largely.

INDUSTRIAL APPLICABILITY

The present invention may be applied to a clothing body of air-conditioned clothing and air-conditioned clothing.

REFERENCE SIGNS LIST

100, 100A Air-conditioned Clothing
1, 1A Clothing Body
11 Cloth Part
111 Opening Hole
112 Collar-Part Air Discharge Part (Air Discharge Part)
113 Sleeve-Part Air Discharge Part (Air Discharge Part)
14, 14A Swell-Controlling Means
141 String-Shaped Member
142 Opening Hole Around String Holder (String Holder)
143 Opening Hole Separate From String Holder (String Holder)
144 Right String-Shaped Member
1441 First Connecting Means
145 Central String-Shaped Member
146 Left String-Shaped Member
1461 Second Connecting Means
2 Fan
BD Body

The invention claimed is:

1. A clothing body of air-conditioned clothing, the clothing body comprising:

a cloth part comprising at least one opening hole to which a fan is attachable, and an air discharge part;

a swell-controlling mechanism which is provided on the cloth part at a position which at least partially overlaps with a position of the opening hole in a height direction of the cloth part, the swell-controlling mechanism comprising a string-shaped member which is provided along a waist circumference on an inner surface of the cloth part; and a string holder which holds the string-shaped member on the inner surface of the cloth part, the string holder comprising a string holder around the opening hole and a string holder separate from the opening hole, wherein:

the string holder around the opening hole is provided around the opening hole of the cloth part, the string holder separate from the opening hole is provided at a position separate from the opening hole of the cloth part, the string holder around the opening hole and the string holder separate from the opening hole comprise an opening through which the string-shaped member passes, an opening of the string holder around the opening hole has a maximum diameter in a horizontal direction smaller than an opening of the string holder separate from the opening hole, and the swell-controlling mechanism controls swell of the cloth part around the opening hole and, when the clothing body is worn with the fan being attached to the opening hole, causes the fan to adhere to a wearer's body.

2. Air-conditioned clothing comprising the clothing body according to claim 1.

3. The clothing body according to claim 1, wherein the string-shaped member comprises a material having elasticity.

4. The clothing body according to claim 1, wherein a first connecting mechanism is provided at one end of the string-shaped member and a second connecting mechanism is provided at the other end of the string-shaped member, and wherein the first connecting mechanism and the second connecting mechanism are configured to be attachable and removable to and from each other in front of the wearer.

5. A clothing body of air-conditioned clothing comprising:

a cloth part comprising two opening holes and an air discharge part, a fan being attachable to each of the two opening holes, and the two opening holes being provided at substantially a same position in a height direction of the cloth part; and a swell-controlling mechanism which is provided on the cloth part at a position which overlaps with the position of the two opening holes in the height direction of the cloth part, the swell-controlling mechanism comprising a string-shaped member which is provided along a waist circumference on an inner surface of the cloth part, wherein:

the string-shaped member comprises:

a right string-shaped member which has one end fixed to the cloth part near a right opening hole of the two opening holes;

a central string-shaped member which has one end fixed to the cloth part near the right opening hole and which has the other end fixed to the cloth part near a left opening hole of the two opening holes; and a left string-shaped member which has one end fixed to the cloth part near the left opening hole, an elasticity of the central string-shaped member is smaller than an elasticity of the right string-shaped member and smaller than an elasticity of the left string-shaped member, and the swell-controlling mechanism controls swell of the cloth part around the two opening holes and, when the clothing body is worn with fans being attached to the two opening holes, causes the fans to adhere to a wearer's body.

6. The clothing body according to claim 5, wherein a first connecting mechanism is provided at the other end of the right string-shaped member, that is not fixed to the cloth part, and a second connecting mechanism is provided at the other end of the left string-shaped member, that is not fixed to the cloth part, and wherein the first connecting mechanism and the second connecting mechanism are configured to be attachable and removable to and from each other in front of the wearer.

7. The clothing body according to claim 5, wherein the swell-controlling mechanism comprises an adjuster to adjust a length of the string-shaped member.

8. Air-conditioned clothing comprising the clothing body according to claim 5.

* * * * *